US006339948B1

(12) United States Patent
Suzumura

(10) Patent No.: US 6,339,948 B1
(45) Date of Patent: Jan. 22, 2002

(54) PROCESS OF FORMING ANNULAR MEMBER FROM CYLINDRICAL MEMBER HAVING RADIAL FLANGE AT ONE END

(75) Inventor: Takashi Suzumura, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/654,453

(22) Filed: Sep. 1, 2000

(30) Foreign Application Priority Data

Sep. 1, 1999 (JP) ..... 11-246997

(51) Int. Cl.[7] ..... B21D 53/16
(52) U.S. Cl. ..... 72/334
(58) Field of Search ..... 72/334, 337, 327, 72/329, 338; 470/41, 162

(56) References Cited

U.S. PATENT DOCUMENTS 4,590,780 A * 5/1986 Bachmann ..... 72/334
5,136,781 A * 8/1992 Stoll ..... 72/334
6,065,322 A * 5/2000 Tabata ..... 72/334

FOREIGN PATENT DOCUMENTS

| | | | | |
|---|---|---|---|---|
| FR | 1320037 | * | 1/1963 | ..... 72/334 |
| GB | 4421 | * | 2/1909 | ..... 72/327 |
| JP | 2-27058 | | 6/1990 | |
| JP | 6-106277 | | 4/1994 | |
| JP | 6-126364 | | 5/1994 | |

* cited by examiner

*Primary Examiner*—Daniel C. Crane
(74) *Attorney, Agent, or Firm*—Pillsbury Winthrop

(57) ABSTRACT

A process of forming an annular member from a cylindrical member, wherein a force is applied to the cylindrical member in an axial direction thereof, to thereby cause plastic deformation at one of opposite axial end portions of the cylindrical member, such that a flange extends in a generally radial direction from one of opposite axial ends of the cylindrical member which corresponds to the above-indicated one of the opposite axial end portions, and a shearing operation is effected on the flange to punch out the annular member.

12 Claims, 11 Drawing Sheets

PROCESS OF FORMING ANNULAR MEMBER FROM CYLINDRICAL MEMBER HAVING RADIAL FLANGE AT ONE END

This application is based on Japanese Patent Application No. 11-246997 filed Sep. 1, 1999, the contents of which are incorporated hereinto by reference.

BACKGROUND OF THE INVENTION

1. Field of the Invention

The present invention relates to a process of forming an annular member such as a ring used for a manufacturing desired products such as automotive vehicle parts, or used as blanks that are to be cold-forged to manufacture desired products.

2. Discussion of Related Art

There are available various processes of forming an annular member as described below. One of the known processes includes a blanking operation and a piercing operation. In this process, a strip 10 supplied from a coil of strip is subjected to a blanking operation to punch out a plurality of workpieces in the form of circular plates 12 while the strip 10 is fed, as shown in FIG. 1A. Each circular plate 12 has the same outside diameter and outer profile as a desired ring member 14 to be manufactured. In the left half of FIG. 1B (on the left side of a one-dot chain line indicated in the figure), the circular plate 12 is shown in cross section. Then, the circular plate 12 is subjected to a piercing operation to remove a radially inner portion thereof, for thereby obtaining the ring member 14, as shown in cross section in the right half of FIG. 1B. The diameter of the radially inner portion to be removed by piercing is equal to the inside diameter of the ring member 14. However, the process including the blanking and piercing operations described above suffers from a considerably low yield ratio.

Another known process of forming a ring member includes a blanking operation, a compressing operation and a piercing operation. In this process, the strip 10 is initially subjected to a blanking operation to punch out a plurality of workpieces also in the form of circular plates 18 each of which has an outside diameter smaller than that of a desired ring member 16 to be manufactured, as shown in FIGS. 2A and 2B. In the left half of FIG. 2B (on the left side of a one-dot chain line indicated in the figure), the circular plate 18 is shown in cross section. Then, the circular plate 18 is subjected to a compressing operation to compress a radially inner portion thereof, as sown in the right half of FIG. 2B, for thereby reducing the thickness of the radially inner portion and enlarging the diameter of the circular plate 18 to the outside diameter of the ring member 16. Finally, the compressed circular plate 18 is subjected to a piercing operation to remove a radially inner portion thereof, for thereby obtaining the ring member 16, as shown in cross section in the right half of FIG. 2C. The diameter of the inner portion to be removed by piercing is equal to the inside diameter of the ring member 16. This process assures a comparatively high degree of hardness of the ring member 16 owing to the compressing operation on the circular plate 18, leading to improved strength of the product to be manufactured from the ring member 16. Further, this process assures a higher yield ratio than the process of FIGS. 1A and 1B. However, the yield ratio in the process of FIGS. 2A–Ac is still unsatisfactory. Further, the present process is not applicable to a strip (blank sheet) having a comparatively small thickness.

A further alternative known process for forming a ring member includes a roll bending operation on a strip.

Described more specifically referring to FIGS. 3A–3C, a plurality of narrow strips 20 shown in cross section in FIG. 3A each having a relatively small width are formed from the strip 10. Each narrow strip 20 is formed into an annular member by roll bending. The thus obtained annular member has a seam 22, as indicated in FIG. 3B. Finally, the annular member is subjected to a calking operation or a welding operation at the seam 22, to thereby form a ring member 24 as shown in FIG. 3C. This process assures a significantly improved yield ratio. In the presence of the seam 22 on the ring member 24, however, the present process suffers from a low strength of the product to be manufactured from the ring member 24. Further, the process is not applicable to a strip having a comparatively large thickness.

JP-A-2-27058 discloses a further alternative process of forming a ring member, which includes a forging operation on one longitudinal end portion of a blank in the form of a round bar, and a shearing operation on the formed longitudinal end portion. Described in detail, the longitudinal end portion of the round bar is subjected to a forging operation with a die set including a female die and a male die, such that a punch portion of the male die is moved into a die hole of the female die, to cause deformation of the longitudinal end portion of the rod held in the die hole, so that a circular recess is formed in the end face of the end portion of the rod. Thus, the circular recess is defined by the annular wall whose outside diameter is larger than the original diameter of the rod. The thus forged longitudinal end portion of the rod is subjected to a shearing operation to cut off only the annular wall portion from the forged end portion of the rod, whereby a ring member constituted by the annular wall is obtained. Where the diameter or transverse cross sectional area of the round rod is comparatively large, a large forging force is required to be applied to the longitudinal end portion, for forming the above-indicated recess defined by the annular wall. Therefore, the present process is not available when the ring member to be manufactured has a comparatively large outside diameter.

SUMMARY OF THE INVENTION

It is therefore an object of the present invention to provide a process which permits an annular member to be formed with a sufficiently high yield ratio, with reduced limitations in the diameter and thickness of the ring member.

The above object may be achieved according to the principle of the present invention, which provides a process of forming at least one annular member from a cylindrical member, comprising the steps of: (a) applying a force to said cylindrical member in an axial direction thereof, to thereby cause plastic deformation at one of opposite axial end portions of the cylindrical member, such that a flange extends in a generally radial direction from one of opposite axial ends of the cylindrical member which corresponds to the above-indicated one of the opposite axial end portions; and (b) effecting a shearing operation on the flange to punch out the annular member.

In the process of the present invention, an axial force is applied to the cylindrical member in its axial direction, in the plastic deformation step, so as to cause plastic deformation at one axial end portion thereof, such that a flange extends from the corresponding one axial end of the cylindrical member in a generally radial direction of the cylindrical member. In the next shearing step, the flange is subjected to a shearing operation to punch out the desired annular member. Therefore, the present process permits the annular member to be formed with reduced limitations in the size and thickness of the annular member.

In a first preferred form of the present invention, a plurality of annular members are successively formed from the cylindrical member, such that the step of applying a force to the cylindrical member and the step of effecting a shearing operation are repeatedly implemented after a first one of the plurality of annular members is punched out. In this instance, the cylindrical member whose flange has been subjected to the shearing operation to punch out each annular member is subjected to the plastic deformation so as to again form the radially extending flange, and this flange is again subjected to a shearing operation to punch out the next one of the plurality of annular members. The process according to the present preferred form of the invention assures a relatively high yield ratio of the annular members.

In a second preferred form of this invention, the process further comprises a step of preparing the cylindrical member which includes a cylindrical wall and an inward flange as the above-indicated flange at one of opposite axial ends of the cylindrical wall, the inward flange being formed by plastic deformation when the cylindrical member is formed such that the inward flange extends radially inwardly of the cylindrical wall, and wherein the inward flange as formed by plastic deformation is further subjected to plastic deformation in the above-indicated step of applying a force to the cylindrical member and the above-indicated step of effecting a shearing operation. In this arrangement, the inward flange is first subjected to the plastic deformation when the cylindrical member with this inward flange is formed, and is again subjected to the plastic deformation with an axial force applied to the cylindrical member such that the material of the corresponding axial end portion of the cylindrical member flows in the radially inward direction of the cylindrical wall. Accordingly, the ring member punched out from the inward flange has an increased strength.

In one advantageous arrangement of the second preferred form of the invention, the cylindrical member with the inward flange is formed by the steps of: subjecting a strip to a blanking operation to punch out a circular plate; subjecting the circular plate to a drawing operation to produce a cylindrical-container consisting of a cylindrical wall and a bottom wall at one of opposite axial ends of the cylindrical wall: and subjecting the bottom wall to a blanking operation to form an opening through the bottom wall, for thereby forming the inward flange, such that the opening has a profile similar to an inner profile of the annular member. This arrangement permits the ring members to be formed from the blank in the form of a strip with a high yield ratio.

In a third preferred form of this invention, the process further comprises a step of preparing the cylindrical member which includes a cylindrical wall and an outward flange as the above-indicated flange at one of opposite axial ends of the cylindrical wall, the inward flange being formed by plastic deformation when the cylindrical member is formed such that the outward flange extends radially outwardly of the cylindrical wall, and wherein the outward flange as formed by plastic deformation is further subjected to plastic deformation in the above-indicated step of applying a force to the cylindrical member and the above-indicated step of effecting a shearing operation. This preferred form of the invention has substantially the same advantage as the second preferred form of the invention described above.

The annular member may be a ring member having circular inner and outer profile, or any other member having elliptical or other inner and outer profiles.

BRIEF DESCRIPTION OF THE INVENTION

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENT

Figure 1A:
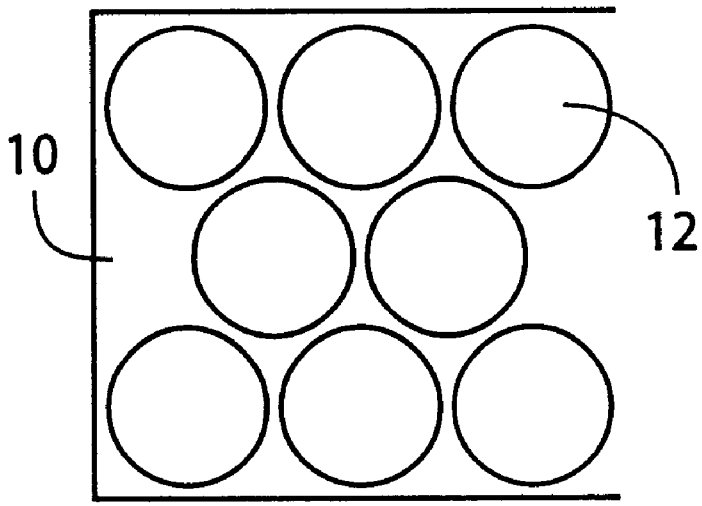
FIG. 1A PRIOR ART
FIGS. 1A and 1B are views illustrating a known process of forming a ring member, which process includes blanking and piercing operations.
Figure 1B:
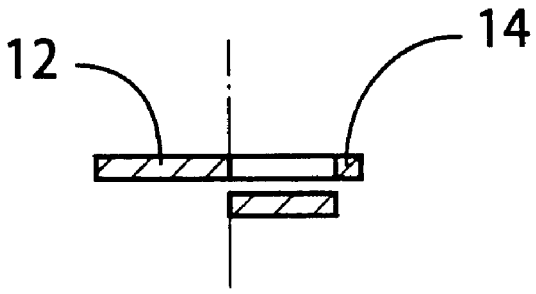
FIG. 1B PRIOR ART
Figure 2A:
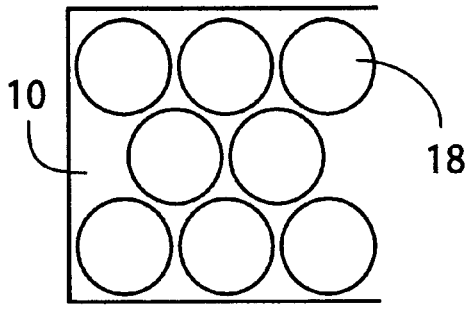
FIG. 2A PRIOR ART
FIGS. 2A, 2B and 2C are views illustrating another known process of forming a ring member, which process includes blanking, compressing and piercing operations.
Figure 2B:
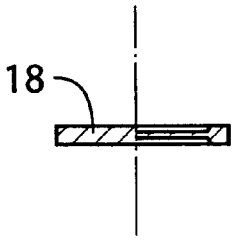
FIG. 2B PRIOR ART
Figure 2C:
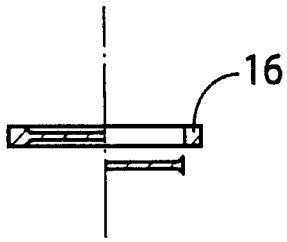
FIG. 2C PRIOR ART
Figure 3A:
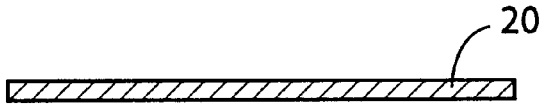
FIG. 3A PRIOR ART
FIGS. 3A, 3B and 3C are views illustrating a further known process of forming a ring member, which process includes a roll bending operation on a narrow strip.
Figure 3B:
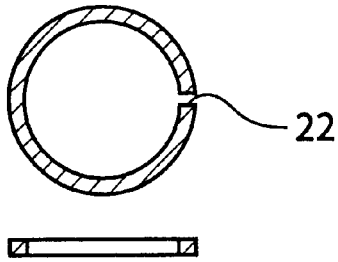
FIG. 3B PRIOR ART
Figure 3C:
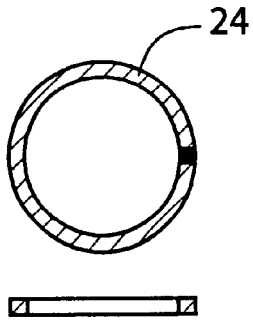
FIG. 3C PRIOR ART
Figure 4:
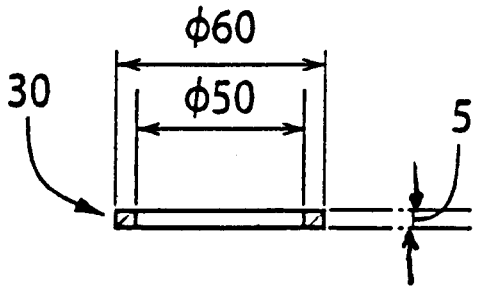
FIG. 4 is a cross sectional view illustrating a ring member formed according to a first embodiment of this invention.

Referring first to FIGS. 4–9, there will be described the first embodiment of the present invention, wherein annular members in the form of ring members 30 shown in FIG. 4 are successively formed. Each ring member 30 has circular inner and outer profiles, and an inside diameter of 50 mm, an outside diameter of 60 mm and a thickness of 5 mm.

Figure 5:
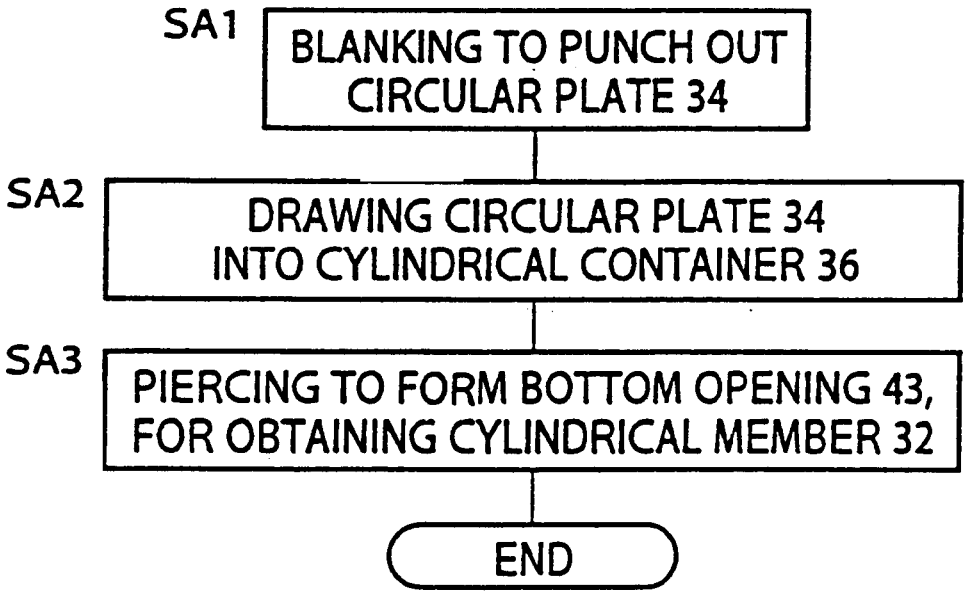
FIG. 5 is a flow chart illustrating steps of forming a cylindrical member from which a plurality of ring members are formed.
Figure 6A:
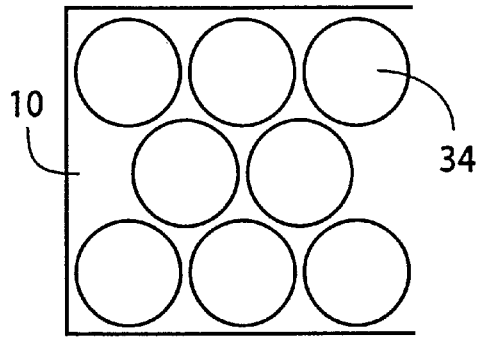
FIGS. 6A, 6B and 6C are views showing a cylindrical container and the cylindrical member to be obtained from the cylindrical container, which cylindrical container and member are formed according to the process illustrated in the flow chart of FIG. 5.
Figure 6B:
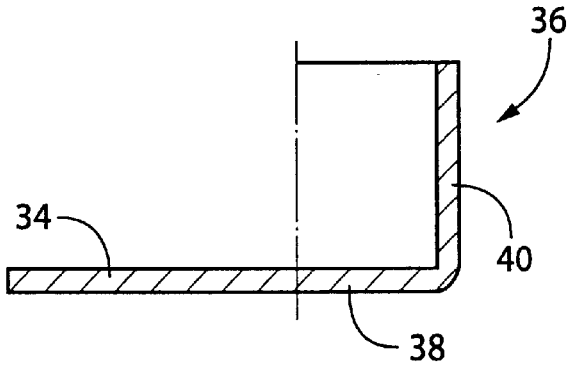

The ring member 30 is formed from a cylindrical member 32, which in turn is formed from a cylindrical container 36, as illustrated in FIGS. 5 and 6. A process of forming the cylindrical container 36 is illustrated in the flow chart of FIG. 5. To form the cylindrical member 32, a strip 10 is subjected to a blanking operation in step SA1 of the flow chart of FIG. 5, to punch out a plurality of workpieces in the form of circular plates 34, as shown in FIG. 6A. It will be understood that the step SA1 is a step of subjecting a strip to a blanking operation to punch out a circular plate. The diameter of the circular plates 34 punched out from the strip 10 is determined based on experimental data, so that a predetermined number of the ring members 30 can be formed from each circular plate 34. In the present embodiment, the diameter of the circular plates 34 is determined to obtain ten ring members 30 from each circular plate 34.

Step SA1 is followed by step SA2 in which the circular plate 34 is subjected to a drawing operation, to produce the cylindrical container 36, which is closed at one of its opposite axial ends and is open at the other axial end. It will be understood that the step SA2 is a step of subjecting the circular plate 34 to produce the cylindrical container 36. The cylindrical container 36 consists of a cylindrical wall 40 and a bottom wall 38 which closes one of the opposite axial ends of the cylindrical wall 40, as shown in cross section in the right half of FIG. 6B. In the left half of FIG. 6B, the circular plate 34 is shown in cross section. The inside diameter of the cylindrical container 36 is made larger by a predetermined amount than the outside diameter of the ring member 30 to be eventually formed. In the present embodiment, the inside diameter of the cylindrical container 36 is 70 mm, while the outside diameter of the ring member 30 is 60 mm, as indicated in FIG. 4.

Figure 6C:
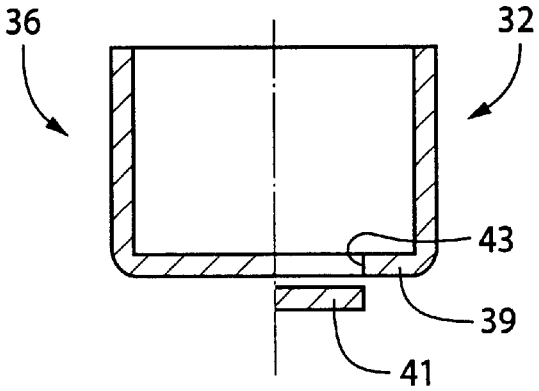

Then, step SA3 is implemented to effect a piercing operation on the bottom wall 38, for punching out a circular plate 41, as shown in FIG. 6C. The circular plate 41 has the outside diameter equal to the outside diameter of the ring member, namely, 60 mm. As a result, the bottom wall 38 is replaced by an inward flange 39 having a circular bottom opening 43 that has a diameter of 60 mm, as indicated in cross section in the right half of FIG. 6C. Thus, the cylindrical member 32 from which the ring members 30 are to be formed is prepared. It will be understood that the step SA3 is a step of subjecting the inward flange 39 of the cylindrical container 36 to a blanking operation to form therethrough the opening 43 whose profile is similar to the inner profile of the ring member 30, so that the cylindrical member 32 is produced.

Referring next to the flow chart of FIG. 7, there will be described steps of successively forming the ring members 30 from the cylindrical member 32 which is produced as described above. Initially, step SB1 is implemented on an axially pressing apparatus in the form of a press 42, to apply an axial force to the cylindrical member 32 so as to effect plastic deformation of one axial end portion of the cylindrical member 32 on the side of the opening 43 such that the material flows from the axial end portion in question in the radially inward direction, so that the diameter of the opening 43 is reduced.

Figure 8:
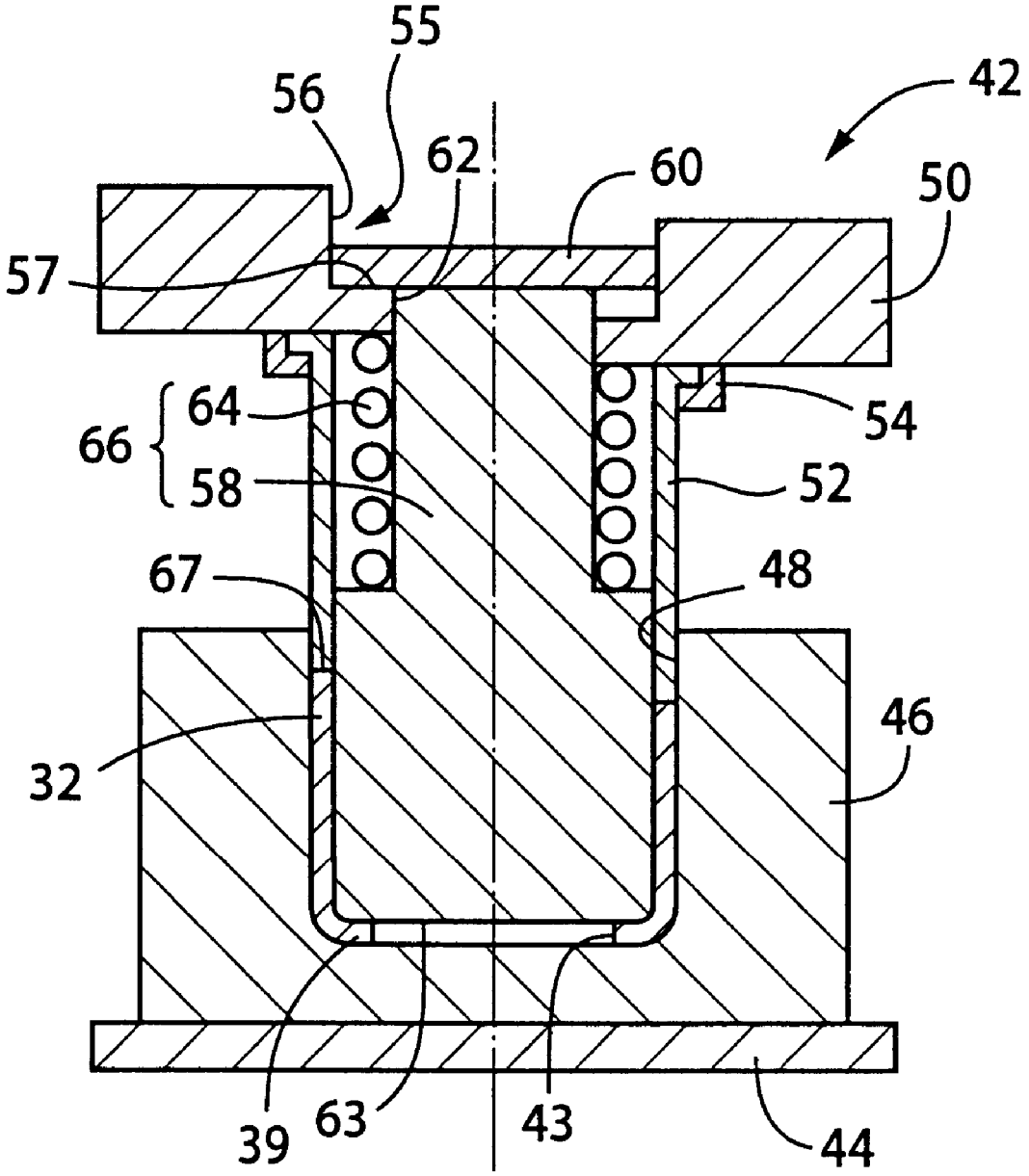
FIG. 8 is an elevational view in cross section schematically showing a press used as an axially pressing apparatus in plastic deformation step SB1 of the flow chart of FIG. 7.

The construction of the press 42 is schematically shown in FIG. 8. The left half of FIG. 8 (to the left of the one-dot chain line in the figure) shows the state of the press 42 before its operation, while the right half of FIG. 8 shows the state of the press 42 after the cylindrical member 32 has been subjected to plastic deformation on the press 42.

The press 42 includes a horizontally extending lower plate 44 and a lower die 46 which has a die hole 48 in which the cylindrical member 32 is fitted. The press 42 further includes an upper plate 50 which is parallel to the lower plate 44 and which is bolted or otherwise fixed to a ram not shown. The upper plate 50 is moved with the ram when the ram is hydraulically moved. To the upper plate 50, there is attached a cylindrical punch 52 through a punch retainer 54. The annular end face of the cylindrical punch 52 on the side of the lower die 46 has a circular shape identical with the shape of the cylindrical member 32 in transverse cross section. That is, the cylindrical punch 52 has the same inside and outside diameters as the cylindrical member 32. The cylindrical punch 52 is attached to the upper plate 50 such that the axis of the punch 52 is perpendicular to the upper plate 50. The axial length and the operating stroke of the ram (i.e., of the upper plate 50) are determined so that the lower end of the punch 52 can be brought into abutting contact with an upper end face 67 of the cylindrical member 32 positioned within the die hole 48.

The upper plate 50 has a stepped hole 55 consisting of a large-diameter portion 56 and a small-diameter portion 62 which cooperate to define an annular shoulder surface 57 therebetween. The press 42 further includes a cylindrical internal pressure member 58 which is supported by the upper plate 50. Namely, the pressure member 58 includes a lower large-diameter portion having a diameter substantially equal to the inside diameter of the cylindrical member 32, and an upper small-diameter portion whose upper end section extends through the small-diameter portion 62 of the stepped hole 55. The small-diameter portion of the pressure member 58 has a diameter substantially equal to the diameter of the small-diameter portion 62, so that the pressure member 58 is axially slidably movable relative to the upper plate 50. The pressure member 58 is provided with a stop 60 in the form of a circular disk fixed to the end face of its small-diameter portion. The stop 60, which has the same diameter of the large-diameter portion 56 of the stepped hole 55, is fitted in this large-diameter portion 56. The large-diameter portion of the pressure member 58 has a horizontal lower end face 63 for contact with the bottom wall of the cylindrical member 32.

A coil spring 64 is disposed in an annular space between the inner circumferential surface of the cylindrical punch 52 and the outer circumferential surface of the small-diameter portion of the internal pressure member 58, such that the upper end of the coil spring 64 is held in contact with the lower surface of the upper plate 50, while the lower end of the coil spring 64 is held in contact with the shoulder surface between the large- and small-diameter portions of the pressure member 58. The coil spring 64 biases the pressure member 58 in the downward direction, that is, toward the bottom of the die hole 48. Thus, the pressure member 58 is normally held in place with the stop 60 held in contact with the annular shoulder surface 57 under the biasing force of the coil spring 64. When the cylindrical punch 52 is moved down with the upper plate 50 relative to the lower die 46, the lower section of the large-diameter portion of the pressure member 58 is moved into the cylindrical member 32 fitted in the die hole 48, so that the cylindrical member 32 is forced onto the bottom surface of the die hole 48. After the lower end face of the pressure member 58 has been brought into contact with the inward flange 39, the stop 60 is moved away from the shoulder surface 57 with the coil spring 64 being compressed, as indicated in the right half of FIG. 8. It will be understood that the internal pressure member 58 and the coil spring 64 cooperate to function as a presser device 66 for holding the cylindrical member 32 in the die hole 48 while forcing the cylindrical member 32 onto the bottom surface of the die hole 48.

Figure 7:
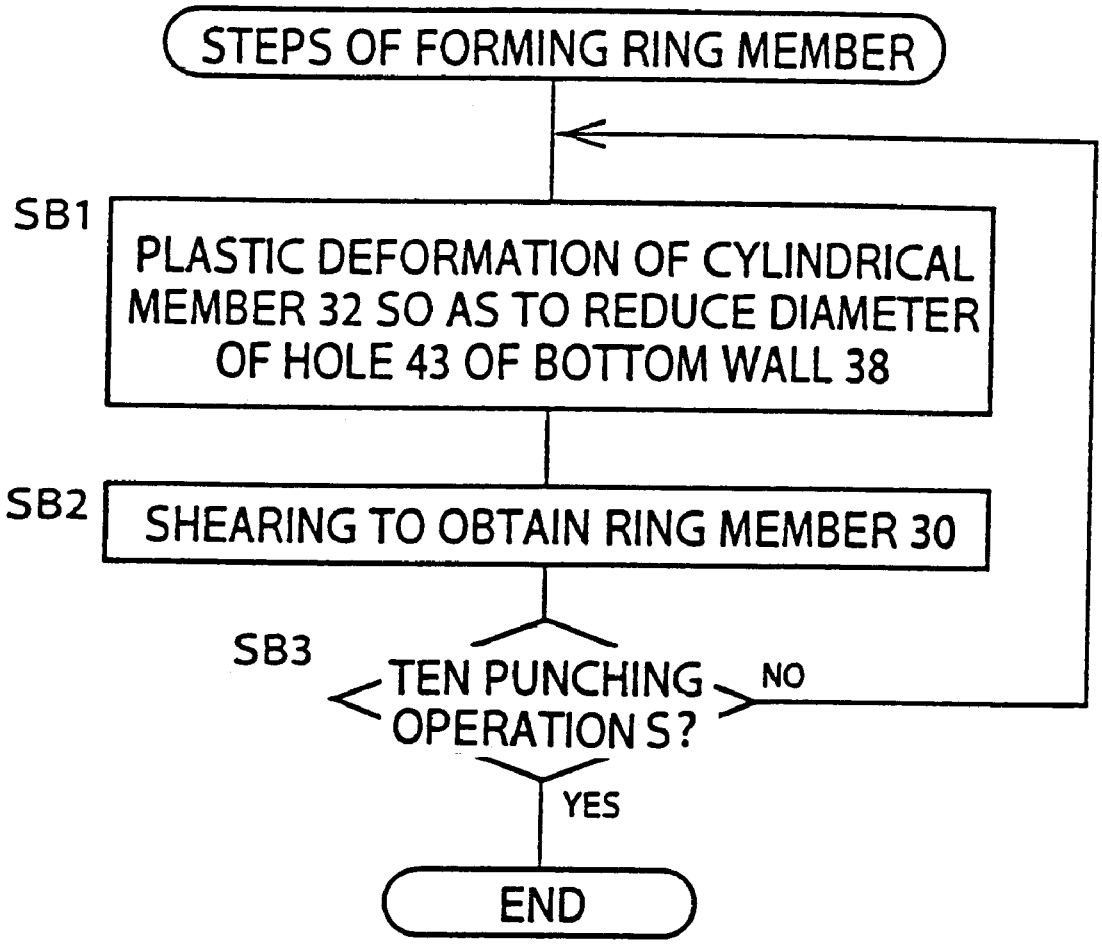
FIG. 7 is a flow chart of steps for successively forming ring members.

In the step SB1 of FIG. 7 indicated above, the upper plate 50 is lowered to move the cylindrical punch 52 into the die hole 48, for abutting contact with the upper end face 67 of the cylindrical member 32, to thereby axially force the cylindrical member 32 so that the upper end face 67 is lowered by a predetermined suitable distance in the axial direction. As indicated above, the diameter (60 mm) of the circular bottom opening 43 of the cylindrical member 32 before the plastic deformation in the step SB1 is equal to the outside diameter of the ring member 30 to be formed. The above-indicated axial distance by which the upper end face 67 is lowered by the downward movement of the punch 52 on the press 42 is determined based on experimental data so that the original diameter (60 mm) of the circular bottom opening 43 (inside diameter of the inward flange 39) is reduced to the inside diameter (50 mm) of the ring member 30. As a result, the reduction of the inside diameter of the inward flange 39 by the plastic deformation of the lower end portion of the cylindrical member 32, the hardness of the member 32 is increased at its lower end portion whose inward flange 39 has the inside diameter equal to the inside diameter of the ring member 30.

Figure 9:
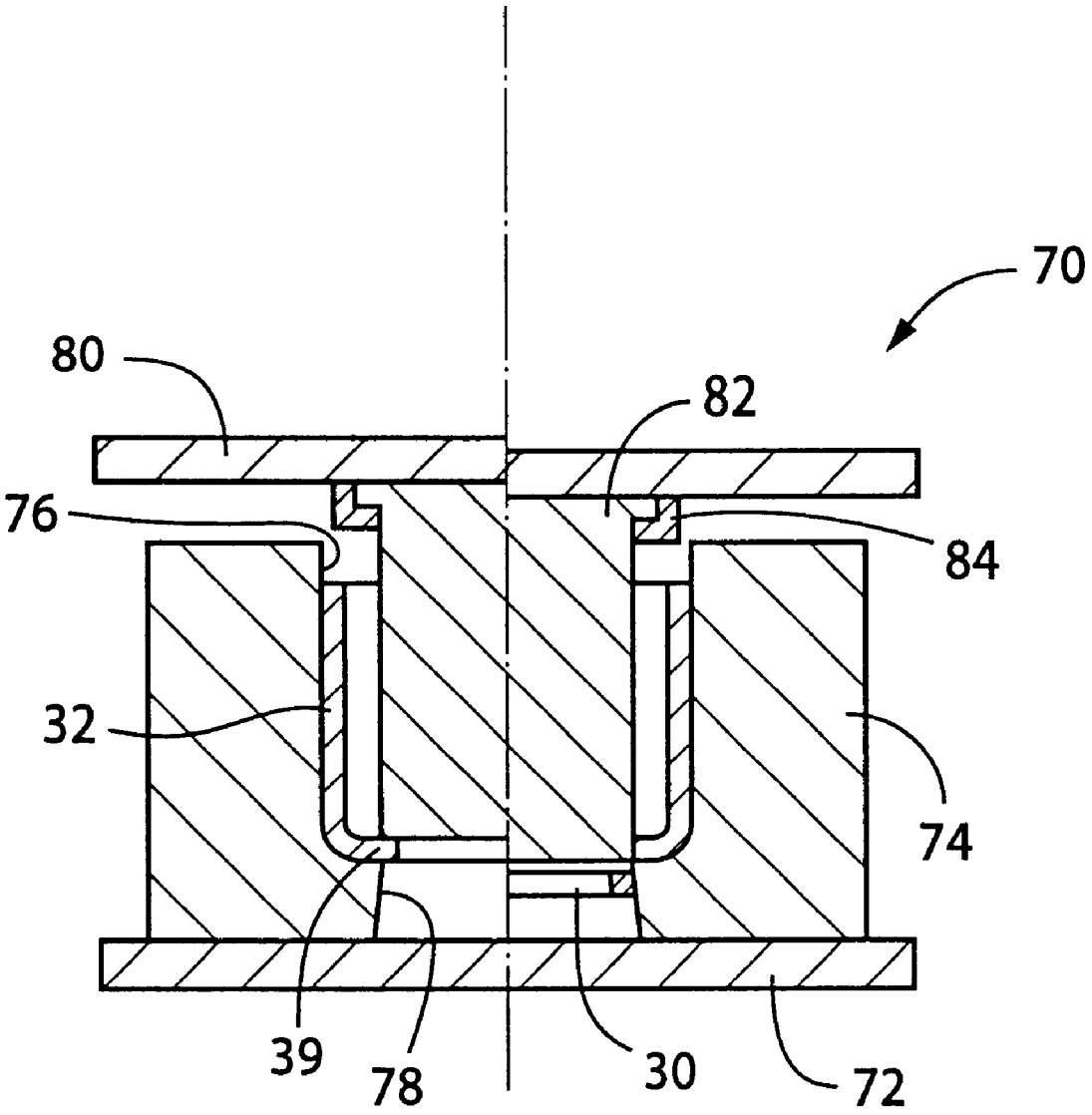
FIG. 9 is an elevational view in cross section schematically showing a blanking or shearing press used in blanking or shearing step SB2 of the flow chart of FIG. 7.

The plastic deformation step SB1 is followed by step SB2 in which the inward flange 39 is subjected to a shearing or blanking operation on a shearing or blanking press 70, to punch out the ring member 30, as shown in the cross sectional view of FIG. 9 showing the shearing press 70. In the left half of FIG. 9 (to the left of the one-dot chain line in the figure), there is shown the cylindrical member 32 before the shearing operation to punch out the ring member 30. In the right half of FIG. 9, there is shown the cylindrical member 32 after the shearing operation, namely, after the ring member 30 is punched out by shearing off the radially inner portion of the inward flange 39.

The shearing or blanking press 70 includes a horizontally extending lower plate 72, and a lower die 74 fixedly mounted on the lower plate 72. The lower die 74 has a die hole 76 in which the cylindrical member 32 which has been subjected to the plastic deformation on the press 42 is fitted. The die hole 76 includes a lower end portion serving as a shearing hole 78. The diameter of the shearing hole 78 at its upper open end is equal to the outside diameter of the ring member 30 to be obtained.

The shearing press 70 further includes an upper plate 80 which is parallel to the lower plate 72 and which is bolted or otherwise fixed to a ram not shown. To the upper plate 80, there is attached a cylindrical punch 82 through a punch retainer 84 such that the cylindrical punch 82 is concentric with the shearing hole 78. The punch 82 has a diameter equal to the outside diameter of the ring member 30, and an axis perpendicular to the lower plate 72 (upper plate 80). The punch 82 has a lower end face parallel to the lower plate 72.

In the shearing step SB2 implemented after the plastic deformation step SB1 in which the inside diameter of the inward flange 39 of the cylindrical member 32 is reduced to the inside diameter (50 mm) of the ring member 30, the upper plate 80 is moved down to lower the cylindrical punch 82 into the cylindrical member 32 fitted in the die hole 76, so that the inward flange 39 having the opening 43 is subjected to a shearing operation by and between the punch 82 and the lower die 74, for thereby punching out the ring member 30 from the inward flange 39.

Then, step SB3 is implemented to determine whether a predetermined number of the ring members 30 have been produced or formed from the cylindrical member 32. In the present embodiment, step SB3 is implemented to determine whether a total of ten ring members 30 have been formed from the cylindrical member 32. If a negative decision (NO) is obtained in step SB3, the control flow goes back to step SB1 to effect the plastic deformation of the cylindrical member 32 on the press 42, so as to reduce the diameter of the bottom opening 43 again to the inside diameter of the ring member 30. Then, step SB3 is implemented to effect the shearing operation again on the inward flange 39 of the cylindrical member 32 on the shearing press 70, so that another ring member 30 is produced. Steps SB1 and SB2 are repeatedly implemented until an affirmative decision (YES) is obtained in step SB3, that is, until a total of ten ring members 30 have been obtained from the same cylindrical member 32. The present process assures the successive formation of the plurality of ring members 30 with a significantly increased yield ratio.

In the process of forming the ring member 30 according to the present embodiment of the invention, the cylindrical member 32 is axially pressed in the plastic deformation step SB1, to plastically deform the lower end portion of the cylindrical member 32, so as to reduce the diameter of the bottom opening 43 to the inside diameter of the ring members 30 to be formed. In the next shearing or blanking step SB2, the plastically deformed inward flange 39 of the cylindrical member 32 is subjected to a shearing or blanking operation to punch out one ring member 30 at one time, with reduced limitations in the size and thickness of the ring member 30.

Further, the present embodiment is adapted such that the cylindrical member 32 is repeatedly subjected to the plastic deformation step SB1 and the shearing step SB2 to punch out a total of ten ring members 30 one after another with a high yield ratio.

It is also noted that the lower end portion of the cylindrical member 32 is repeatedly subjected to the axial and radially inward plastic deformation, such that the extreme end portion of the cylindrical wall 40 of the cylindrical member 32 eventually provides the inward flange 39, and so that the inward flange 39 is sufficiently hardened owing to the repeated implementation of the plastic deformation step SB1. Accordingly, the ring members 30 formed from the inward flange 39 have a high degree of strength. In particular, the strength of the ring members 30 which are formed after a relatively large number of implementation of the plastic deformation step SB1 is considerably high.

In the present process, the cylindrical member 32 is formed by initially performing a blanking operation on the strip 10 to punch out a plurality of circular plates 34 in the blanking step SA1, then performing a drawing operation on each circular plate 34 so as to form the cylindrical container 36 in the drawing step SA2, and finally performing a piercing operation on the bottom wall 38 of the cylindrical container 36 so as to form the bottom opening 43 through the inward flange 39 in the piercing step SA3.

Referring next to the cross sectional views of FIGS. 10–13, there will be described other embodiments of the present invention, in which the same reference signs as used in the first embodiment of FIGS. 4–9 are used to identify the functionally corresponding elements.

Figure 10:
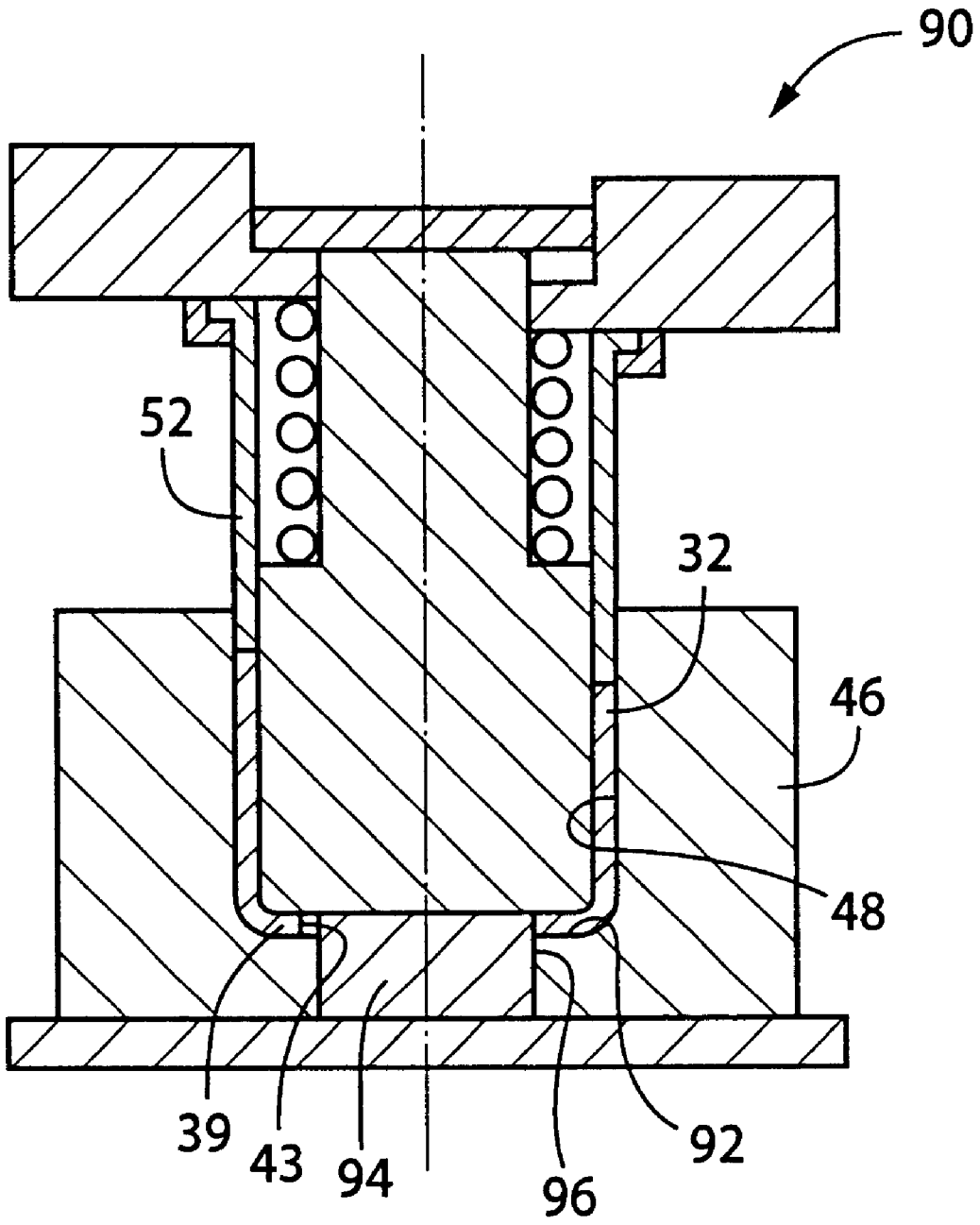
FIG. 10 is a press used as an alternative axially pressing apparatus in the plastic deformation step SB1, in a second embodiment of the present invention.

In the embodiment of FIG. 10, an axially pressing apparatus in the form of a press 90 is used in place of the press 42 of FIG. 8. The press 90 employs a cylindrical stop 94 incorporated in the lower portion of the lower die 46 such that the stop 94 partially projects into the die hole 48, from a bottom surface 92 of the die hole 48. The amount of upward projection of the cylindrical stop 94 from the bottom surface 92 is equal to the thickness of the inward flange 39. The cylindrical stop 94 has a diameter equal to the inside diameter of 50 mm of the ring member 30.

In the plastic deformation step SB1, the cylindrical member 32 fitted in the die hole 48 of the lower die 46 of the press 90 is subjected to the plastic deformation so that the inner circumferential surface of the bottom opening 43 is brought into abutting contact with an outer circumferential surface 96 of the cylindrical stop 94. Thus, the cylindrical stop 94 functions as a member for reducing the diameter of the bottom opening 43 exactly to the inside diameter (50mm) of the ring member 30 to be formed. In this second embodiment, too, the thus plastically deformed cylindrical member 32 is subjected to a shearing operation on the press 70 of FIG. 9, to punch out the ring member from the bottom wall 38, in the shearing or blanking step SB2.

As described above, the second embodiment which employs the press 90 including the cylindrical stop 94 permits accurate plastic deformation of the cylindrical member 32 so as to form the bottom wall 38 such that the bottom opening 43 has the diameter which is exactly the same as the inside diameter of the ring member 30 to be formed. Accordingly, the present embodiment permits improved dimensional accuracy of the ring members 30.

Figure 11:
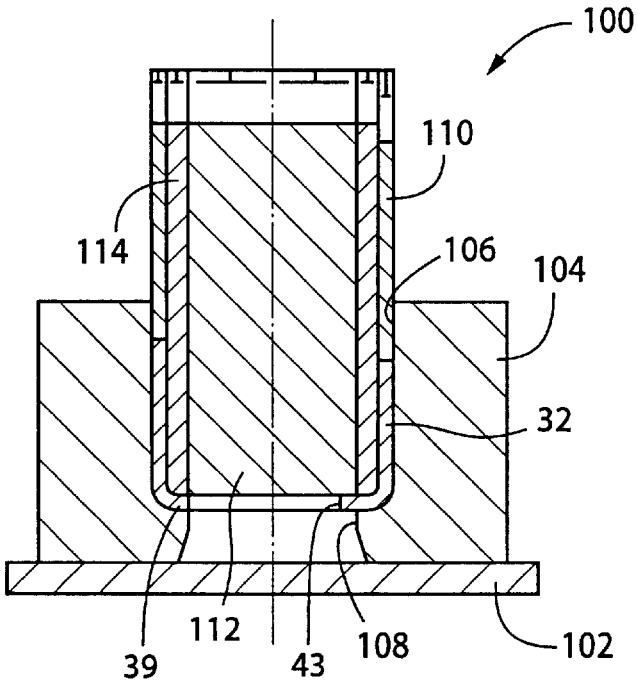
FIG. 11 is an elevational view in cross section schematically showing a press which is used in a further embodiment of the invention and which functions as an axially pressing apparatus and a blanking or shearing apparatus.
Figure 12:
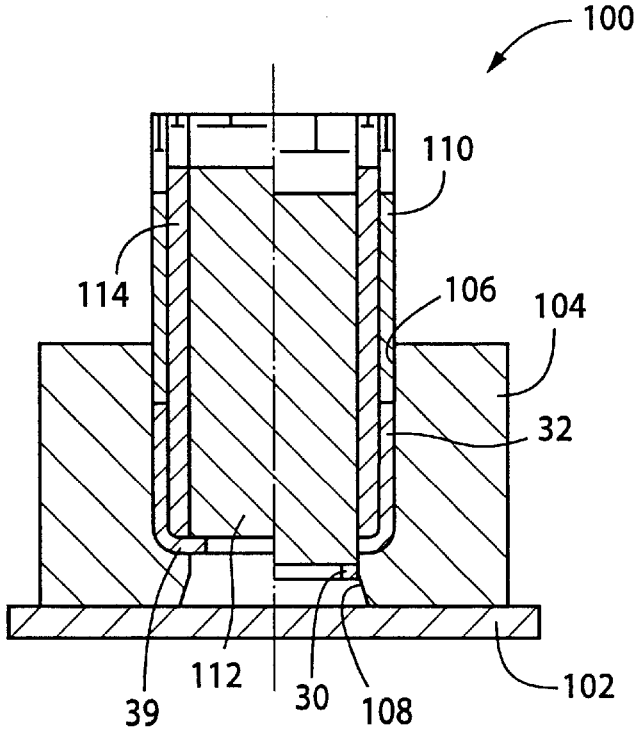
FIG. 12 is an elevational view in cross section showing the shearing step SB2 in a third embodiment of this invention.

In the third embodiment of FIGS. 11 and 12, a press 100 is used in place of the presses 42 and 70 of FIGS. 8 and 9 used in the first embodiment. Namely, the press 100 serves as not only the axially pressing apparatus but also the shearing press. The left half of FIG. 11 shows the cylindrical member 32 before the plastic deformation, while the right half of FIG. 11 shows the cylindrical member 32 after the plastic deformation. The left half of FIG. 12 shows the cylindrical member 32 before the shearing or blanking operation on the inward flange 39, while the right half of FIG. 12 shows the cylindrical member 32 after the shearing operation on the inward flange 39.

The press 100 includes a horizontally extending lower plate 102, and a lower die 104 fixedly mounted thereon. The lower die 104 has the same configuration as the lower die 74 of the press 70 of FIG. 9, and has a die hole 106 in which the cylindrical member 32 is fitted. The die hole 106 includes a lower end portion serving as a shearing hole 108 whose diameter is equal to the outside diameter (60mm) of the ring member 30 to be formed. The press 10 further includes a cylindrical outer punch 110 having the same inside and outside diameters as the cylindrical member 32. The outer punch 110 is fixed to a first ram not shown, such that the outer punch 110 is concentric with the cylindrical member 32 fitted in the die hole 106. The press 10 further includes a cylindrical inner punch 112 having an outside diameter equal to the outside diameter of the ring member 30. The inner punch 112 is fixed to a second ram not shown, such that the inner punch 112 is concentric with the shearing hole 108. Between the outer and inner punches 110, 112, there is disposed a cylindrical intermediate punch 114 fixed to a third ram not shown. The intermediate punch 114 is axially slidable in contact with the outer and inner punches 110, 112. The first, second and third rams are connected to respective hydraulically operated cylinders, so that the three punches 110, 112, 114 connected to the respective rams are axially movable toward and away from the lower plate 102. That is, the press 100 is a hydraulically operated double-action press. The mutually independent connections of the outer, inner and intermediate punches 110, 112, 114 with the respective hydraulically operated cylinders are indicated by symbols in the upper end of FIGS. 11 and 12.

The left half of FIG. 11 shows the operating state of the press 100 in which the lower end face of the outer punch 110 is in abutting contact with the upper end face of the cylindrical member 32 fitted in the die hole 106 of the lower die 104, while the lower end face of the intermediate punch 114 is in contact with the inner surface of the inward flange 39 of the cylindrical member 32. In this state, the outer punch 110 is lowered a predetermined distance to effect the plastic deformation of the lower end portion of the cylindrical member 32 so that the diameter of the bottom opening 43 is reduced to the inside diameter (50 mm) of the ring member 30 to be formed. This is the plastic deformation step SB1. The right half of FIG. 11 shows the cylindrical member 32 after the plastic deformation step SB1 is implemented.

The left half of FIG. 12 shows the same state of the press 100 as shown in the right half of FIG. 11. The right half of FIG. 12 shows the ring member 30 which has been punched out from the inward flange 39 in the shearing or blanking step SB2. In this shearing step SB2, the inner punch 112 is lowered to effect the shearing operation on the inward flange 39 so as to punch out the ring member 30 whose outside diameter is equal to the diameter of the inner punch 112.

Then, the inner punch 112 is moved upwards away from the inward flange 39 of the cylindrical member 32, and the outer punch 110 is again lowered to effect the plastic deformation of the cylindrical member 32 so as to reduce the diameter of the bottom opening 43 to the inside diameter of the ring member 30 to be formed. Then, the inner punch 112 is again lowered to punch out the ring member 30 from the bottom wall 38. By repeating the above steps, the plurality of ring members 30 can be formed one after another from the same cylindrical members 32.

Figure 13:
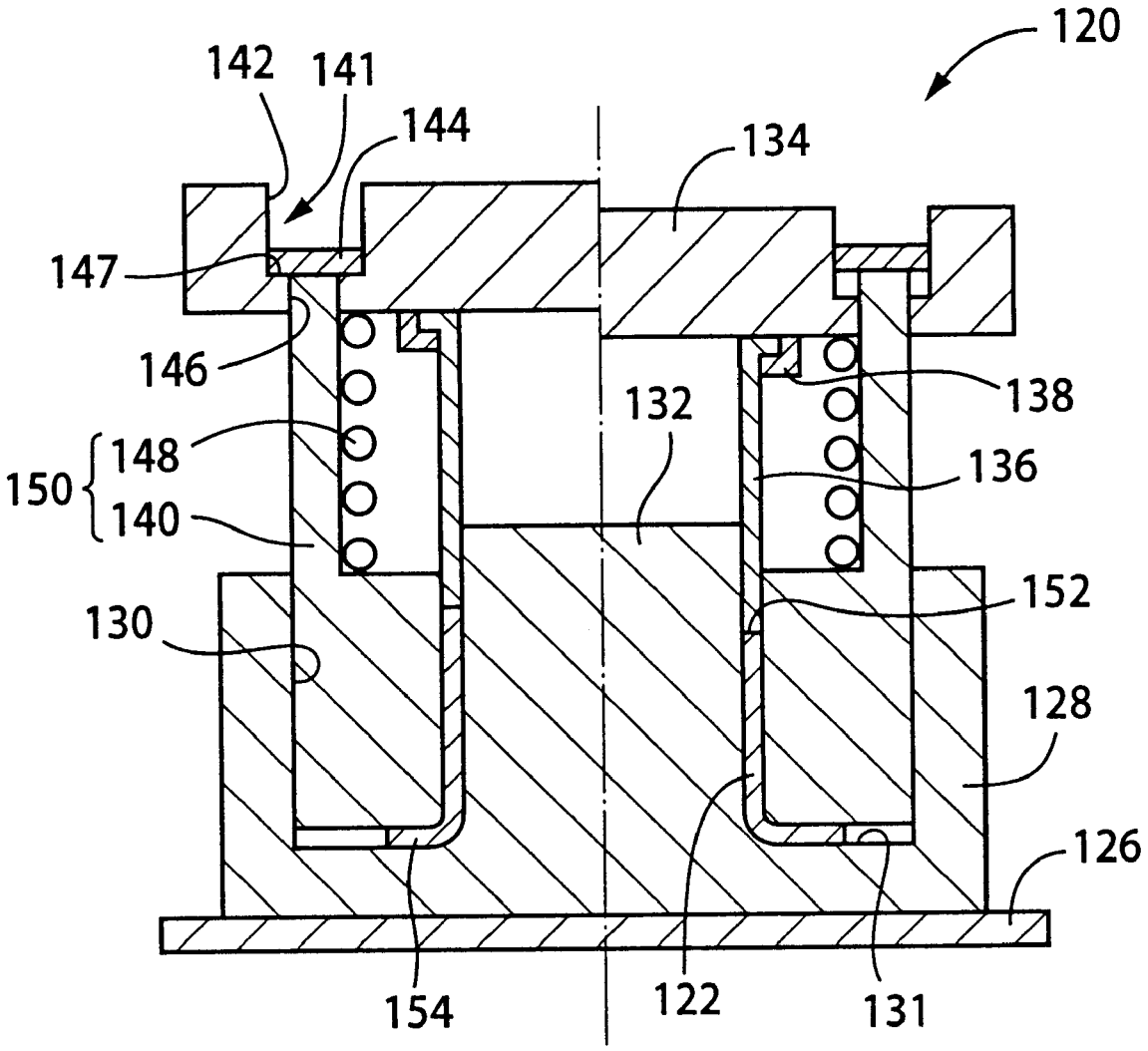
FIG. 13 is an elevational view in cross section schematically showing a press used as the axially pressing apparatus in a fourth embodiment of the invention.

In the fourth embodiment of FIG. 13, a press 120 is used as the axially pressing apparatus, in place of the press 42 of FIG. 8. The press 120 is adapted to implement the plastic deformation step SB1 on a cylindrical member 122, which is different from the cylindrical member 32 in that the cylindrical member 122 has an outward flange portion 154 at the lower end, rather than the inward flange 39. The press 120 is adapted to effect the plastic deformation of the lower end portion of the cylindrical member 122 which includes the outward flange 154. The cylindrical member 122 may be formed, for example, by cutting a tubular member into a plurality of tubes, and subjecting one axial end portion of each tube to a spinning operation, for plastically deforming the end portion of the tube so as to form the outward flange 154.

The press 120 includes a horizontally extending lower plate 126, and a lower die 128 fixedly mounted on the lower plate 126. The lower die 128 has a die hole 130, and includes a central cylindrical projection 132 which extends upward from a horizontal bottom surface 131 of the die hole 130. The cylindrical projection 132 has a diameter equal to the inside diameter of the cylindrical member 122 and an axial length larger than the axial length of the cylindrical member 122.

The press 120 further includes an upper plate 134 which is parallel to the lower plate 126 and which is bolted or otherwise fixed to a ram not shown. When the ram is vertically moved by a hydraulically operated cylinder, the upper plate 134 is moved with the ram. To the upper plate 134, there is attached a cylindrical punch 136 through a punch retainer 138, such that the lower portion of the punch 136 is engageable with the upper end portion of the cylindrical projection 132. The cylindrical punch 136 has the same outside and inside diameters as the cylindrical members 122.

The press 120 further includes an annular external pressure member 140 having an outside diameter equal to the diameter of the die hole 130. The external pressure member 140 consists of an upper portion and a lower portion having a smaller inside diameter than the upper portion. The upper plate 134 has an annular stepped hole 141 consisting of an upper portion 142 and a lower portion 146 having a smaller outside diameter than the upper portion 142. The upper and lower portions 142, 146 having the different outside diameters and the same inside diameter cooperate to define an annular shoulder surface 147 therebetween. The upper end section of the upper portion of the pressure member 140 extends through the lower portion 146 of the stepped hole 141. An annular stop 144 having the same outside and inside diameters as the annular upper portion 142 of the stepped hole 141 is fixed to the upper end face of the upper portion of the pressure member 140 such that the annular stop 144 is slidably movable within the upper portion 142 of the stepped hole 141. Namely, the external pressure member 140 is axially movable with the stop 144 relative to the upper plate 134 in the press-forming direction of the press 120.

The lower portion of the pressure member 140 has an inside diameter equal to the outside diameter of the cylindrical member 122, and an outside diameter equal to the diameter of the die hole 130. The pressure member 140 is radially positioned relative to the upper plate 134 and the lower die 128 so that the lower portion of the pressure member 140 is engageable with the die hole 130. A coil spring 148 is disposed in an annular space between the upper portion of the pressure member 140 and the cylindrical punch 136 such that the upper end of the coil spring 148 is held in contact with the lower surface of the upper plate 134 while the lower end of the coil spring 148 is held in contact with the annular shoulder surface defined between the upper and lower portions of the pressure member 140. Thus, the coil spring 148 biases the pressure member 140 in the downward direction so that the annular stop 144 is normally held in contact with the annular shoulder surface 147. When the upper plate 134 is lowered with the punch 136 and the pressure member 140, toward the lower die 128 in which the cylindrical member 122 is fitted in the die hole 130 and on the central projection 132, the pressure member 140 is brought into engagement with the outer circumferential surface of the cylindrical member 122. Eventually, the pressure member 140 is brought into contact at its lower end face with the outward flange 154 of the cylindrical member 122. After the pressure member 140 has been brought into contact with the outward flange 154, the stop 144 is moved away from the shoulder surface 147, with the coil spring 148 being compressed, as indicated in the right half of FIG. 13. Thus, the external pressure member 140 and the spring 148 cooperate to function as a presser device 150 for holding the cylindrical member 122 in the die hole 130 while forcing the cylindrical member 122 onto the bottom surface 131 of the die hole 130.

In operation of the press 120 constructed as described above, the cylindrical member 122 is set in the die hole 130, in engagement with the central cylindrical projection 132, and the upper plate 134 is lowered to move down the punch 136 by a predetermined distance so that an upper end face 152 of the cylindrical member 122 is lowered by a predetermined distance. The distance of this downward movement of the upper end face 152 is determined based on experimental data so that the diameter of the outward flange 154 which is originally equal to the inside diameter of 50 mm of the ring member 30 to be formed is increased to the outside diameter of 60 mm of the ring member 30. That is, the application of an axial force from the punch 136 to the cylindrical member 122 in the plastic deformation step SB1 causes the material of the lower end portion of the cylindrical wall of the member 122 to flow in the radially outward direction, so that the outside diameter of the outward flange is increased to the diameter of the ring member 30 to be obtained.

Then, the outward flange 154 of the cylindrical member 122 which has been subjected to the plastic deformation step SB1 is subjected to the blanking or shearing step SB2 on a shearing or blanking press, to punch out the ring member 30. The steps SB1 and SB2 are repeatedly implemented to successively produce a plurality of ring members 30 using the same cylindrical member 122.

While the presently preferred embodiments of this invention have been described above in detail by reference to the accompanying drawings, for illustrative purpose only, it is to be understood that the invention may be otherwise embodied.

Although the illustrated embodiments are adapted to produce the ring members 30 as the end product, the principle of the present invention is applicable to the production of intermediate products in the form of rings from which the ring members are obtained as the end products by a further blanking or shearing operation.

In the illustrated embodiments, the inward flange 39 of the cylindrical member 32 and the outward flange 154 of the cylindrical member 122 have a circular inner or outer profile, and the ring members 30 having circular inner and outer profiles (an annular transverse cross sectional shape) are produced by the plastic deformation of the cylindrical members 32, 122 and the blanking operation on the inward or outward flange 39, 154. However, the inward or outward flange of the cylindrical member may have an elliptical or other transverse cross sectional shape, so that elliptical members and other annular members whose transverse cross sectional shape is not circular or is relatively complicated may be produced from the elliptical or otherwise-shaped flange of the cylindrical member.

In the first embodiment, the cylindrical container 36 is first prepared from the strip 10, and then the cylindrical member 32 is prepared by removing a radially inner portion (41) of the bottom wall 34 of the cylindrical container 36. However, the cylindrical member 32 having the inward flange 39 may be obtained by cutting a tubular member to obtain a tube having a desired length, and subjecting the end portion of the tube to a spinning operation or other plastic deformation to form the inward flange at one end of the tube.

Although the inward flange 39 and the outward flange 154 of the cylindrical members 32, 122 extend radially inwardly or outwardly of the cylindrical wall of the cylindrical members 32, 122, that is, extend exactly perpendicularly with respect to the axis of the cylindrical members 32, 122, the angle of the inward and outward flanges with respect to the axis of the cylindrical members may be other than 90°, provided the ring members 30 can be punched out from such inward or outward flange.

In the first embodiment, the original inside diameter (60 mm) of the inward flange 39 as formed by punching out the circular plate 41 is larger than the inside diameter (50 mm) of the ring member 30 to be formed, and this original inside diameter is reduced to the inside diameter of the ring member 30 in the first implementation of the plastic deformation step SB1. However, the original inside diameter of the inward flange 39 may be equal to the inside diameter of the ring member 30. In this case, the blanking or shearing operation on the inward flange in the step SB2 is implemented before the plastic deformation step SB1. Namely, the plastic deformation step SB1 is implemented for the first time after the first ring member 30 is obtained. In this arrangement, the diameter of the circular plate 41 to be removed is smaller, so that the amount of wasting of the material is saved.

It is to be understood that the present invention may be embodied with various other changes, modifications and improvements, which may occur to those skilled in the art, without departing from the spirit and scope of the invention defined in the following claims:

What is claimed is:

1. A process of forming at least one annular member from a tubular cylindrical member, comprising:

a force applying step of applying a force to said tubular cylindrical member in an axial direction thereof, to thereby cause plastic deformation at one of opposite axial end portions of said tubular cylindrical member, such that a flange extends in a generally radial direction from one of opposite axial ends of said tubular cylindrical member which corresponds to said one of said opposite axial end portions; and a shearing step of effecting a shearing operation on said flange to punch out said annular member, wherein said tubular cylindrical member is fixed to a die having a die hole during implementation of said force applying step such that said tubular cylindrical member is held in contact in said one of the opposite axial ends with a bottom surface of said die hole, whereby said force is applied to said tubular cylindrical member by a punch which is moved in said axial direction relative to said die so as to be brought into abutting contact with the other of said opposite axial ends, while said tubular cylindrical member is held in said flange by a pressure member which has an end face brought into contact with said flange and which forces said flange onto said bottom surface of said die hole, said pressure member being movable in said axial direction relative to said punch so that a spacing distance between said end face of said pressure member and said bottom surface of said die hole is held substantially unchanged during movement of said punch relative to said die in said axial direction, for thereby permitting said flange to extend in said generally radial direction while keeping a thickness of said flange substantially constant.

2. A process according to claim 1, wherein each of said at least one annular member is a ring member having circular inner and outer profiles.

3. A process according to claim 1, wherein said flange of said tubular cylindrical member consists of an inward flange which extends radially inwardly from said one of said opposite axial ends of said tubular cylindrical member, and wherein said die is fittable at said die hole onto said tubular cylindrical member while said pressure member is fittable into said tubular cylindrical member so that said tubular cylindrical member is fitted in said die hole and on said pressure member during the implementation of said force applying step.

4. A process according to claim 1, wherein said flange of said tubular cylindrical member consists of an outward flange which extends radially outwardly from said one of said opposite axial ends of said tubular cylindrical member, and wherein said die has a cylindrical projection which extends from said bottom surface of said die hole and which is fittable into said tubular cylindrical member while said pressure member consists of an annular member which is fittable into said die hole and onto said tubular cylindrical member so that said tubular cylindrical member is fitted on said cylindrical projection while said pressure member is fitted in said die hole and on said tubular cylindrical member during the implementation of said force applying step.

5. A process according to claim 1, further comprising a step of preparing said tubular cylindrical member which includes a cylindrical wall and an outward flange as said flange at one of opposite axial ends of said cylindrical wall, said outward flange being formed by plastic deformation when said tubular cylindrical member is formed such that said outward flange extends radially outwardly of said cylindrical wall, and wherein said outward flange as formed by plastic deformation is further subjected to plastic deformation in said force applying step and said shearing step.

6. A process of forming at least one annular member from a cylindrical member, comprising the steps of:

applying a force to said cylindrical member in an axial direction thereof, to thereby cause plastic deformation at one of opposite axial end portions of said cylindrical member, such that a flange extends in a generally radial direction from one of opposite axial ends of said cylindrical member which corresponds to said one of said opposite axial end portions; and effecting a shearing operation on said flange to punch out said annular member, wherein said at least one annular member consists of a plurality of annular members which are successively formed from said cylindrical member, such that said step of applying a force to said cylindrical member and said step of effecting a shearing operation are repeatedly implemented after a first one of said plurality of annular members is punched out.

7. A process according to claim 6, further comprising a step of preparing said cylindrical member which includes a cylindrical wall and an outward flange as said flange at one of opposite axial ends of said cylindrical wall, said outward flange being formed by plastic deformation when said cylindrical member is formed such that said outward flange extends radially outwardly of said cylindrical wall, and wherein said outward flange as formed by plastic deformation is further subjected to plastic deformation in said step of applying a force to said cylindrical member and said step of effecting a shearing operation.

8. A process of forming at least one annular member from a cylindrical member, comprising the steps of:

applying a force to said cylindrical member in an axial direction thereof, to thereby cause plastic deformation at one of opposite axial end portions of said cylindrical member, such that a flange extends in a generally radial direction from one of opposite axial ends of said cylindrical member which corresponds to said one of said opposite axial end portions; and effecting a shearing operation on said flange to punch out said annular member, said process further comprising a step of preparing said cylindrical member which includes a cylindrical wall and an inward flange as said flange at one of opposite axial ends of said cylindrical wall, said inward flange being formed by plastic deformation when said cylindrical member is formed such that said inward flange extends radially inwardly of said cylindrical wall, and wherein said inward flange as formed by plastic deformation is further subjected to plastic deformation in said step of applying a force to said cylindrical member and said step of effecting a shearing operation.

9. A process according to claim 8, wherein said cylindrical member with said inward flange is formed by the steps of: subjecting a strip to a blanking operation to punch out a circular plate; subjecting said circular plate to a drawing operation to produce a cylindrical container consisting of a cylindrical wall and a bottom wall at one of opposite axial ends of said cylindrical wall: and subjecting said bottom wall to a blanking operation to form an opening through said bottom wall, for thereby forming said inward flange, such that said opening has a profile similar to an inner profile of said annular member.

10. A process according to claim 8, wherein said step of applying a force to said cylindrical member comprises forcing said cylindrical member in said axial direction such that an end face at the other of said opposite axial ends of said cylindrical member is lowered by a distance which is determined such that an inside diameter of said inward flange is reduced to an inside diameter of said ring member to be formed, as a result of said plastic deformation at said one of said opposite axial end portions of said cylindrical member.

11. A process according to claim 10, wherein said step of applying a force to said cylindrical member comprises providing a cylindrical stop which has an outer circumferential surface for abutting contact with an inner periphery of said inward flange, said outer circumferential surface having a diameter equal to said inside diameter of said ring member.

12. A process of forming at least one annular member from a cylindrical member, comprising the steps of:

applying a force to said cylindrical member in an axial direction thereof, to thereby cause plastic deformation at one of opposite axial end portions of said cylindrical member, such that a flange extends in a generally radial direction from one of opposite axial ends of said cylindrical member which corresponds to said one of said opposite axial end portions; and effecting a shearing operation on said flange to punch out said annular member, said process further comprising a step of preparing said cylindrical member which includes a cylindrical wall and an outward flange as said flange at one of opposite axial ends of said cylindrical wall, said outward flange being formed by plastic deformation when said cylindrical member is formed such that said outward flange extends radially outwardly of said cylindrical wall, and wherein said outward flange as formed by plastic deformation is further subjected to plastic deformation in said step of applying a force to said cylindrical member and said step of effecting a shearing operation, wherein said step of applying a force to said cylindrical member comprises forcing said cylindrical member in said axial direction such that an end face at the other of said opposite axial ends of said cylindrical member is lowered by a distance which is determined such that an outside diameter of said outward flange formed by said plastic deformation is increased to an outside diameter of said ring member to be formed, as a result of said plastic deformation at said one of said opposite axial end portions of said cylindrical member.

* * * * *